US006916413B2

(12) United States Patent
Lowe

(10) Patent No.: US 6,916,413 B2
(45) **Date of Patent: *Jul. 12, 2005**

(54) ELECTRO-PLATING APPARATUS AND METHOD

(75) Inventor: John Michael Lowe, Market Harborough (GB)

(73) Assignee: TDAO Limited, Leicestershire (GB)

( * ) Notice: Subject to any disclaimer, the term of this patent is extended or adjusted under 35 U.S.C. 154(b) by 187 days.

This patent is subject to a terminal disclaimer.

(21) Appl. No.: 10/318,779

(22) Filed: Dec. 13, 2002

(65) Prior Publication Data

US 2003/0164301 A1 Sep. 4, 2003

Related U.S. Application Data

(63) Continuation-in-part of application No. 09/525,586, filed on Mar. 15, 2000, now Pat. No. 6,495,018.

(30) Foreign Application Priority Data

Mar. 13, 2000 (GB) ..... 0005886

(51) Int. Cl.[7] ..... C25D 21/10; C25D 21/12; C25D 17/00; C25D 5/08

(52) U.S. Cl. ..... 205/148; 205/83; 205/84; 205/96; 205/97; 205/118; 205/133; 205/137; 204/228.6; 204/228.7; 204/229.2; 204/229.4; 204/229.8; 204/230.2; 204/232

(58) Field of Search ..... 205/81, 82, 83, 205/84, 95, 96, 97, 118, 133, 137, 148; 204/228.1, 228.6, 228.7, 229.2, 229.4, 229.8, 230.2, 232

(56) References Cited

U.S. PATENT DOCUMENTS

| | | | | |
|---|---|---|---|---|
| 4,304,641 | A | 12/1981 | Grandia et al. | 204/23 |
| 4,755,271 | A | 7/1988 | Hosten | 204/198 |
| 4,800,001 | A | 1/1989 | Ott et al. | 205/125 |
| 5,156,730 | A | 10/1992 | Bhatt et al. | 205/118 |
| 6,139,712 | A | 10/2000 | Patton et al. | 205/143 |
| 6,153,064 | A | 11/2000 | Condra et al. | 204/198 |
| 6,159,354 | A | 12/2000 | Contolini et al. | 205/96 |

*Primary Examiner*—Michael J. Feely

(74) *Attorney, Agent, or Firm*—Jones, Walker, Waechte, Poitevent, Carrere & Denegre, L.L.P.

(57) ABSTRACT

Electroplating station S has a head 1 with anode 2, to one side of which there is located an electrically neutral wall 3. The width of anode 2 is provided to accommodate the width of web 6. Serrations 9 are provided on the anode 2, especially in the area of top surface 8. A passageway 4 for electrolyte 5 is between anode 2 and wall 3. Mesh 11 is located at a throat section 12 of passageway 4 shortly before the start of the guide 7. In addition, mesh 13 is located further upstream in passageway 4 as an alternative and/or as an addition to mesh 11. Guide 7 of wall 3, serrations 9, and meshes 11 and 13 enhance and maximize the production of stream-wise vortices. These vortices cause a substantial increase in the ion flow, which overcomes boundary layers and results in additional deposition of copper onto the web 6.

24 Claims, 18 Drawing Sheets

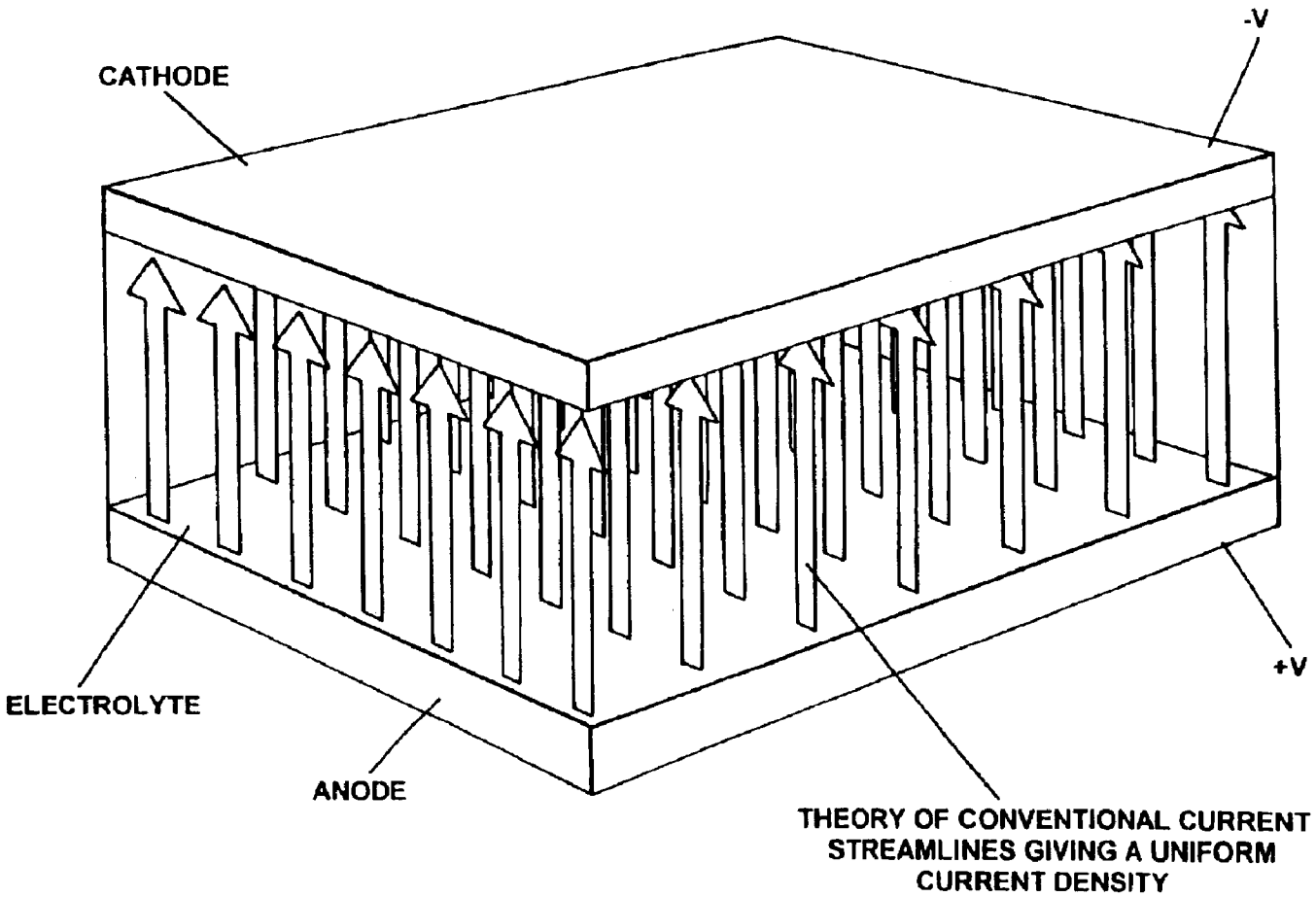
*Fig.* 8

ELECTRO-PLATING APPARATUS AND METHOD

This application is a continuation-in-part of U.S. application Ser. No. 09/525,586 filed on Mar. 15, 2000, now U.S. Pat. No. 6,495,018 issued on Dec. 17, 2002, which claims priority to Great Britain Patent No. 0005886.7 filed on Mar. 13, 2000, both of which are incorporated by reference herein in their entirety.

I. FIELD OF INVENTION

The present invention relates to apparatus for electroplating and to a method of electroplating.

II. BACKGROUND OF INVENTION

A standard electro-plating process involves applying a current density of about $3\times10^2$ Amps meter$^{-2}$ in an electroplating bath containing an electrolyte, typically resulting in the deposition on a cathode of a thickness of copper of about $6\times10^{-7}$ meters minute$^{-1}$.

Various attempts have been made to improve the deposition process, for example by the use of a rotating disc electrode. At best, such attempts have resulted in increases of up to three times in the deposition thickness by allowing an equivalent increase in current density. A major problem associated with electroplating, especially when high deposition rates are attempted, is the irregularity of deposition. Another major problem is the need for all areas that are to be plated to be electrically connected.

To obtain a uniform plating deposit using existing methods, the required situation is that given by two parallel, co-axial and equi-potential conducting planes separated by a medium of homogenous resistance. If a potential difference exists between the two planes, then the current will flow between and normal to the two planes with uniform density (see FIG. 8). If the medium separating the two planes is an electrolyte of suitable composition containing adequate and suitable ions of the material to be deposited, then a uniform deposition of the material will be made on the plane which is at the more negative potential. The amount of the deposit is dependent upon the material type and the total electrical charge.

In practice, the situation described above does not occur, due to surface roughness of the two planes and the lack of homogeneity of the electrolyte. Also, practical difficulties, associated with achieving true parallelism of the planes and the possible irregular pattern of the conductive surface of the negative (target) plane and the restrictions of the electrolyte flow, to some or all of the target plane surface, add to the lack of uniformity of the current density within the electrolyte. This results in irregular deposits of material on the target surface.

FIG. 9 shows the distortion of the current stream, and therefore current density distribution, due to the irregularity of the target (negative) surface. Further distortions due to the irregularities in the positive surface and variations in the electrolyte resistance are not shown. FIG. 10 shows the accentuation of the irregularities in the target surface due to the unequal current density distribution. The interaction of unequal current density and surface irregularity can be seen to be mutually progressive.

Several techniques have been employed to offset these effects including the use of current diversions (robber bars) at the target surface. Such techniques are only partially successful and are inherently inefficient. There are few, if any, practical techniques for dealing with situations in which the target surface has areas which are to be plated but which are not electrically connected.

III. SUMMARY OF INVENTION

The present invention provides electroplating apparatus comprising means to direct an electrolyte stream to target, means to control the amount of reduction, and/or rate thereof, of ions in selected regions of said target, said control means comprising a means to measure the current flowing to said regions of said target, and a means to control the current applied to said regions in dependence on an output of said measurement means, and a means to effect swirling of the electrolyte stream in the vicinity of said regions, thereby enhancing the creation of vortices upon impingement of the stream with the said regions in order to increase the ion reduction rate.

The present invention also provides an electroplating method of directing a stream of electrolyte to a target region, controlling the amount of reduction, and/or rate thereof, of ions in selected regions of the target, measuring the current flowing to said target region, controlling the current applied to said target region in dependence on an output of the measurement step and swirling said electrolyte to enhance the creation of vortices upon impingement of the stream with said regions thereby increasing the ion reduction rate. The electro-plating apparatus may comprise means to monitor the current flow in some or all regions of the target. The electroplating apparatus may comprise means to regulate the current flow to each region so that the material deposition rate for each region may be independently varied.

The direction means may comprise a hollow, elongate body along the interior of which electrolyte passes (e.g. by pumping, or other pressurising methods, or other methods for inducing flow) for exit through an outlet and towards a target being a substrate maintained at a negative voltage relative to part of the body, whereby the target forms a cathode and the part of the body forms an anode. The anode part of the body may be formed of a single element or of a plurality of electrically isolated elements or rods. In a particular, advantageous embodiment, the direction means comprises a plurality of hollow tubes for the flow of electrolyte along the interior of the tubes and towards the target.

Electro-plating apparatus may include any one or more of the following features:

- the control means comprises means to regulate the current applied to each of a plurality of separate regions of the target.
- the control means comprises means to regulate the size and/or duration of current applied to each of a plurality of separate regions of the target.
- the control means comprises means to measure the current flowing to a region of the target and means to control the current applied to that region in dependence on the output of the measurement means.
- control means operable to provide a reduction layer of uniform thickness on the target.
- control means operable to provide a reduction layer on the target wherein different regions have predetermined reduction thicknesses.
- control means operable to provide a target with a uniform reduction thickness in selected regions.
- the control means comprises means to control the current flow to each region so that the ion reduction rate for each region may be independently varied.
- the control means comprises means to monitor the current flow in all regions of the target.

the direction means comprises a hollow, elongate body for the passage of electrolyte along the interior of the body.

a single element anode.

an anode formed of a plurality of generally parallel solid rods.

an anode formed of a plurality of generally parallel tubes through which electrolyte passes.

means to effect swirling of the electrolyte in the vicinity of contact with the target.

swirling means comprises shaping of the body and/or the outlet such that the vortices are created or enhanced.

serrations in the leading edge of the anode.

The electro-plating apparatus may comprise means to effect movement of the electrolyte in the region of contact with the target, thereby to enhance impingement between electrolyte and target to optimise ion availability. In one embodiment, the shape of the body and the outlet are such that swirling is created or enhanced, typically by the inclusion of serrations in the leading edge of the anode.

The present invention comprises a method of electroplating comprising directing electrolyte to a target and controlling the amount of deposition, and/or rate thereof, of material in selected regions of the target. The method may comprise monitoring the current flow in some or all regions of the target. The method may comprise regulating the current flow to each region so that the material deposition rate for each region may be independently varied.

The method may comprise effecting movement of the electrolyte in the region of contact with the target, thereby to enhance impingement between electrolyte and target to optimise ion availability. In one embodiment, the shape of the body and the outlet are such that swirling is created or enhanced, typically by the inclusion of serrations in the leading edge of the anode. The present invention also provides a computer program product directly loadable into the internal memory of a digital computer, comprising software code portions for performing the steps of a method according to the present invention, when said product is run on a computer. The present invention also provides a computer program product stored on a computer useable medium, comprising a computer readable program means for causing the computer to control the amount of deposition, and/or rate thereof, of material in selected regions of the target. The present invention also provides electronic distribution of a computer program as defined in the present invention.

IV. BRIEF DESCRIPTION OF DRAWINGS

Figure 1:
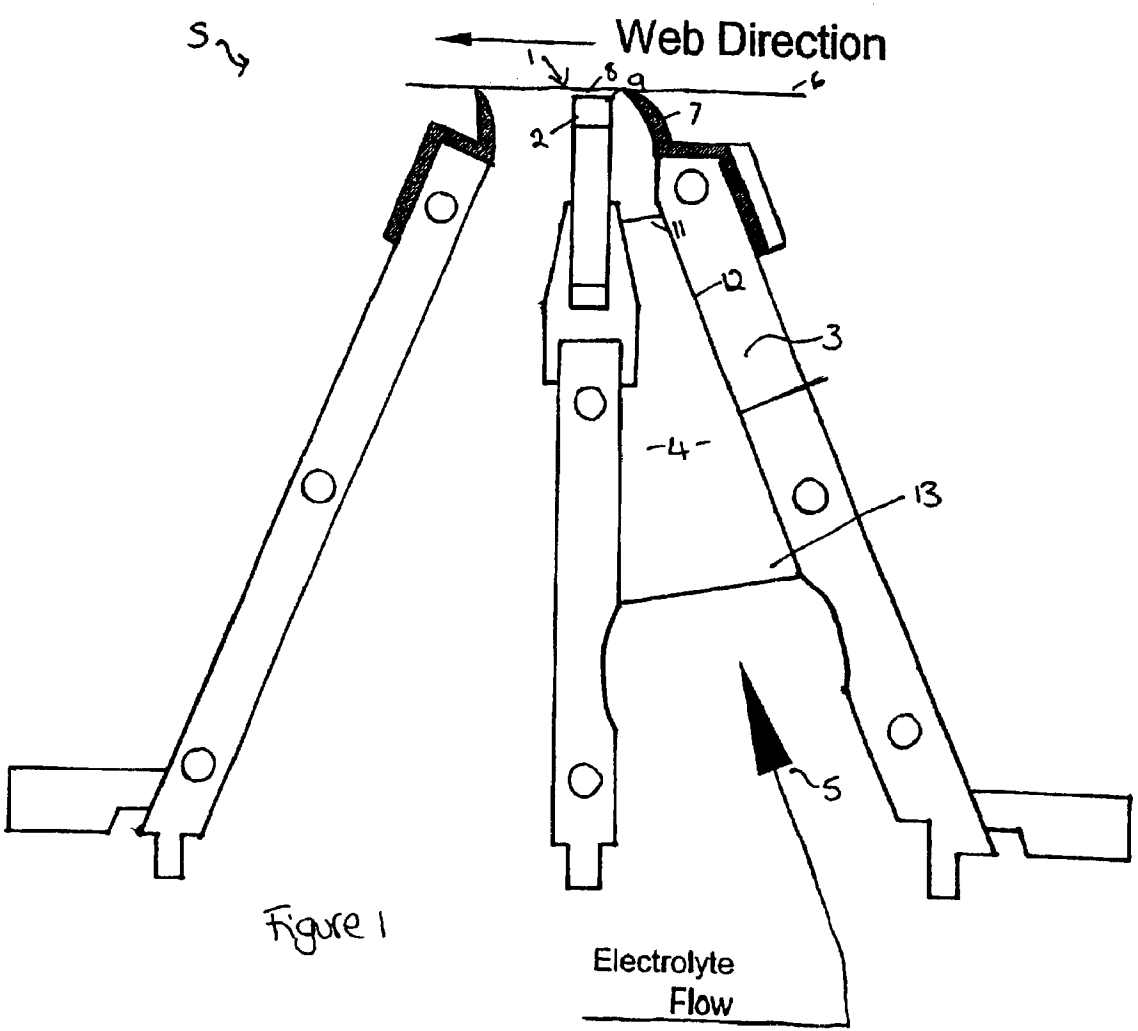
FIG. 1 is a side view of an electro-plating station of the present invention.
Figure 3A:
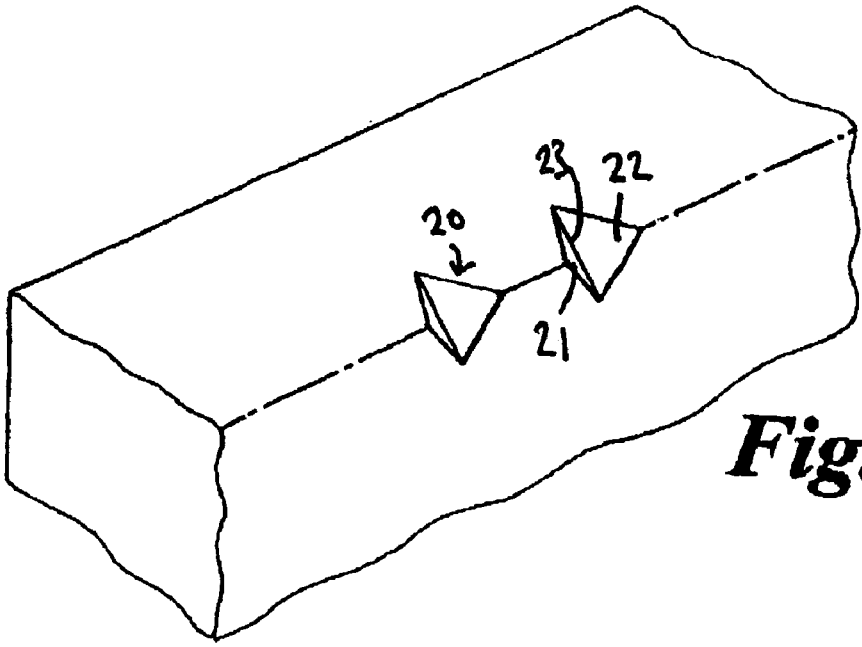

FIGS. 3A, B and C are views of alternative serrations in the station of FIG. 1.

Figure 4:
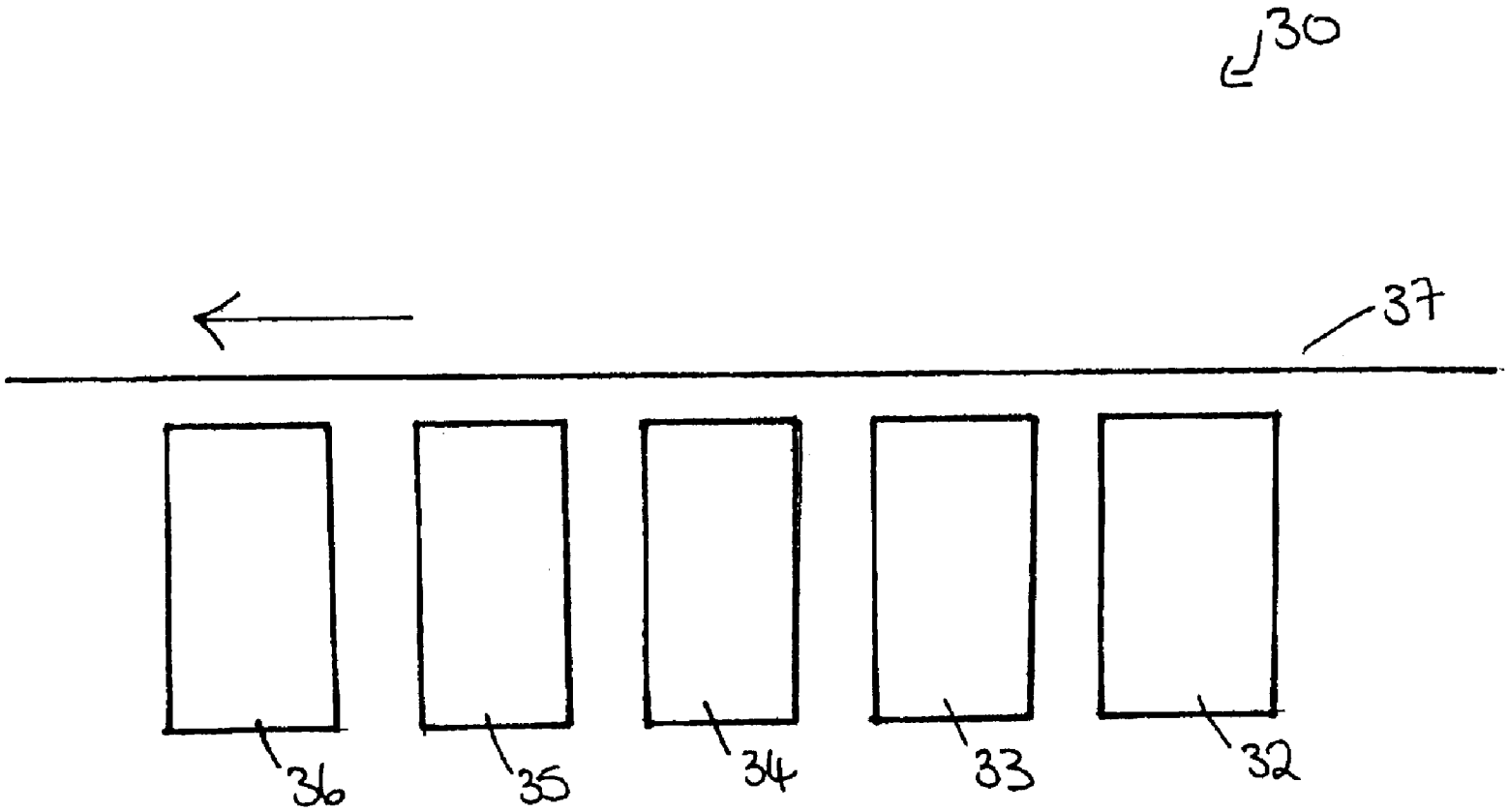

FIG. 4 shows an electroplating machine being a number of stations of FIG. 1.

Figure 5:
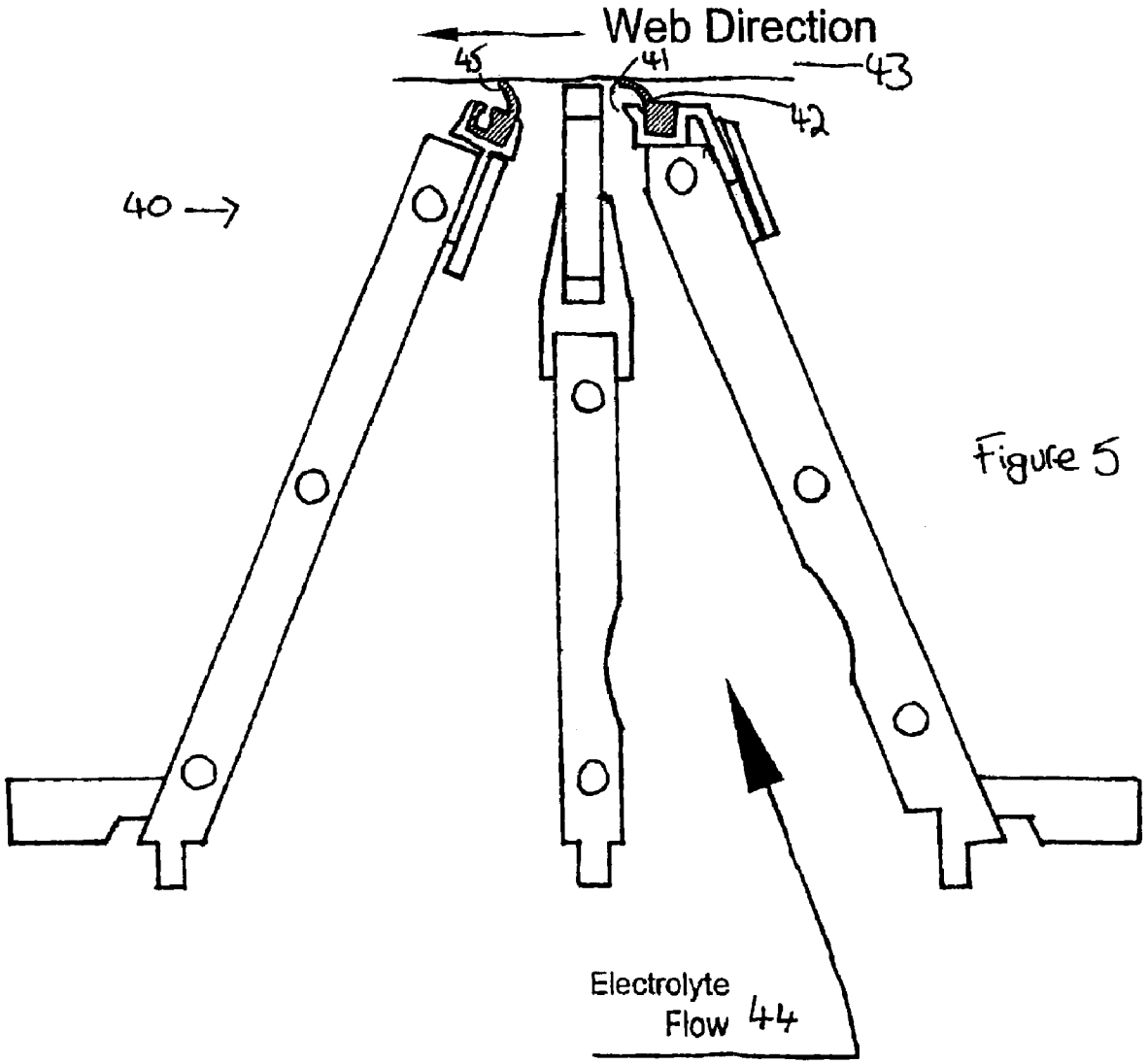
Figure 6A:
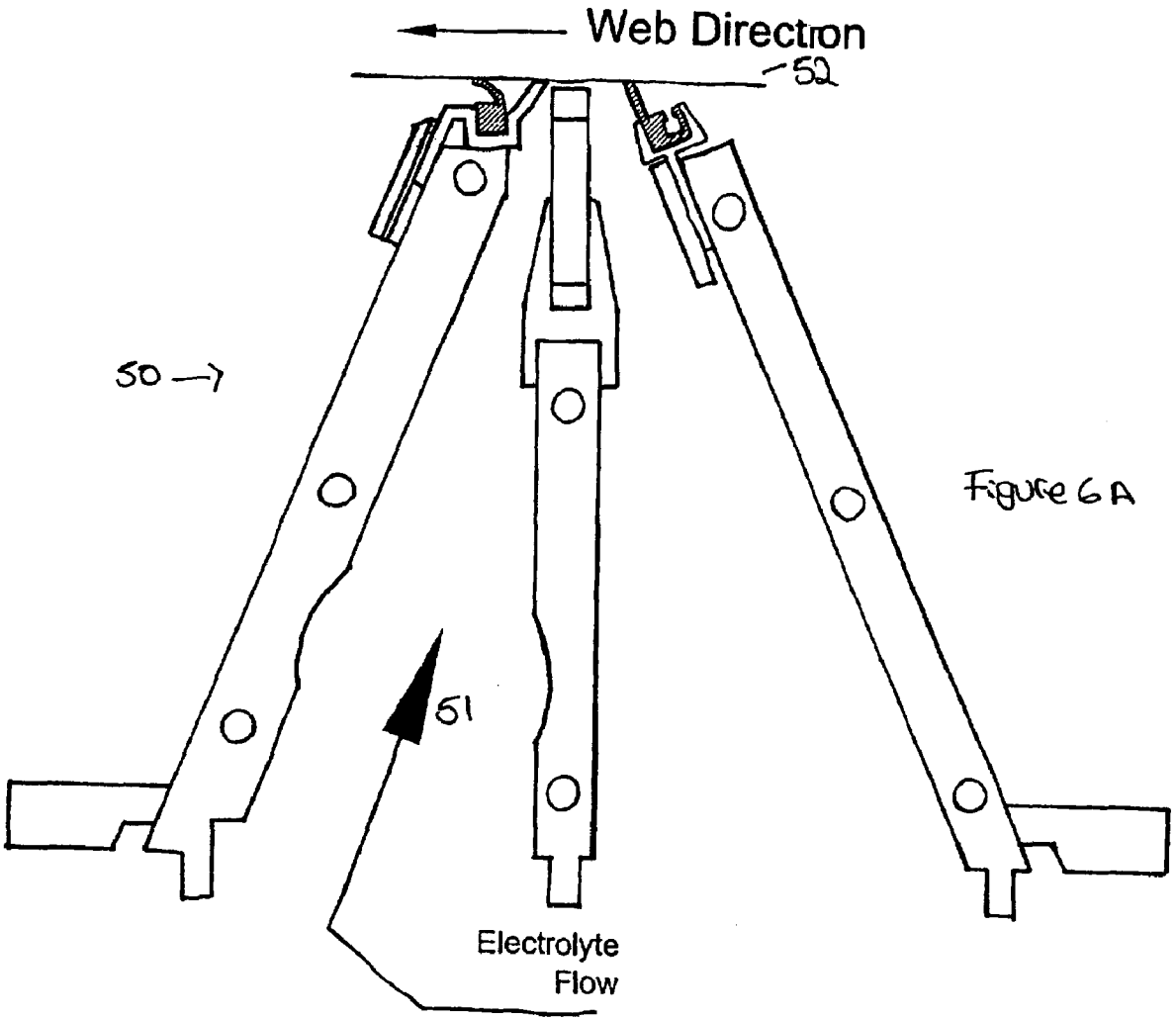
Figure 6B:
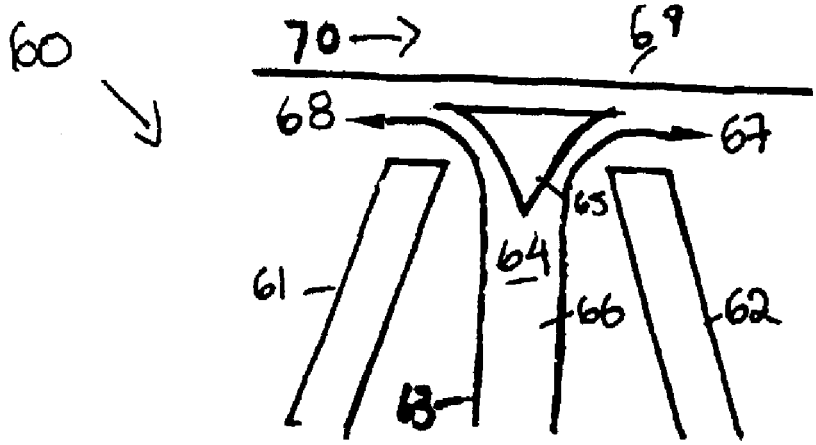

FIGS. 5, 6A and 6B show alternatives to the station of FIG. 1.

Figure 7A:
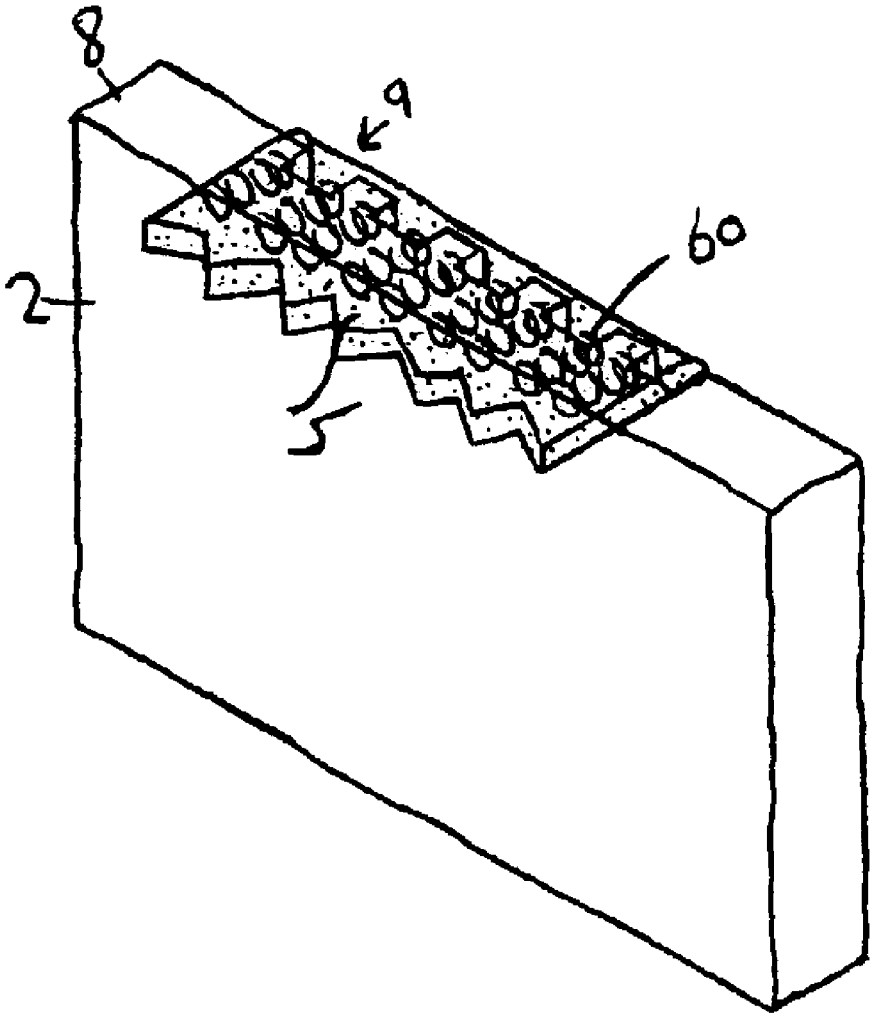

FIGS. 7A and B shows the circular motion of a vortex formed in the electrolyte stream of the station of FIG. 1.

FIG. 8 is a schematic view of the idealised current flow between two conducting planes.

Figure 9:
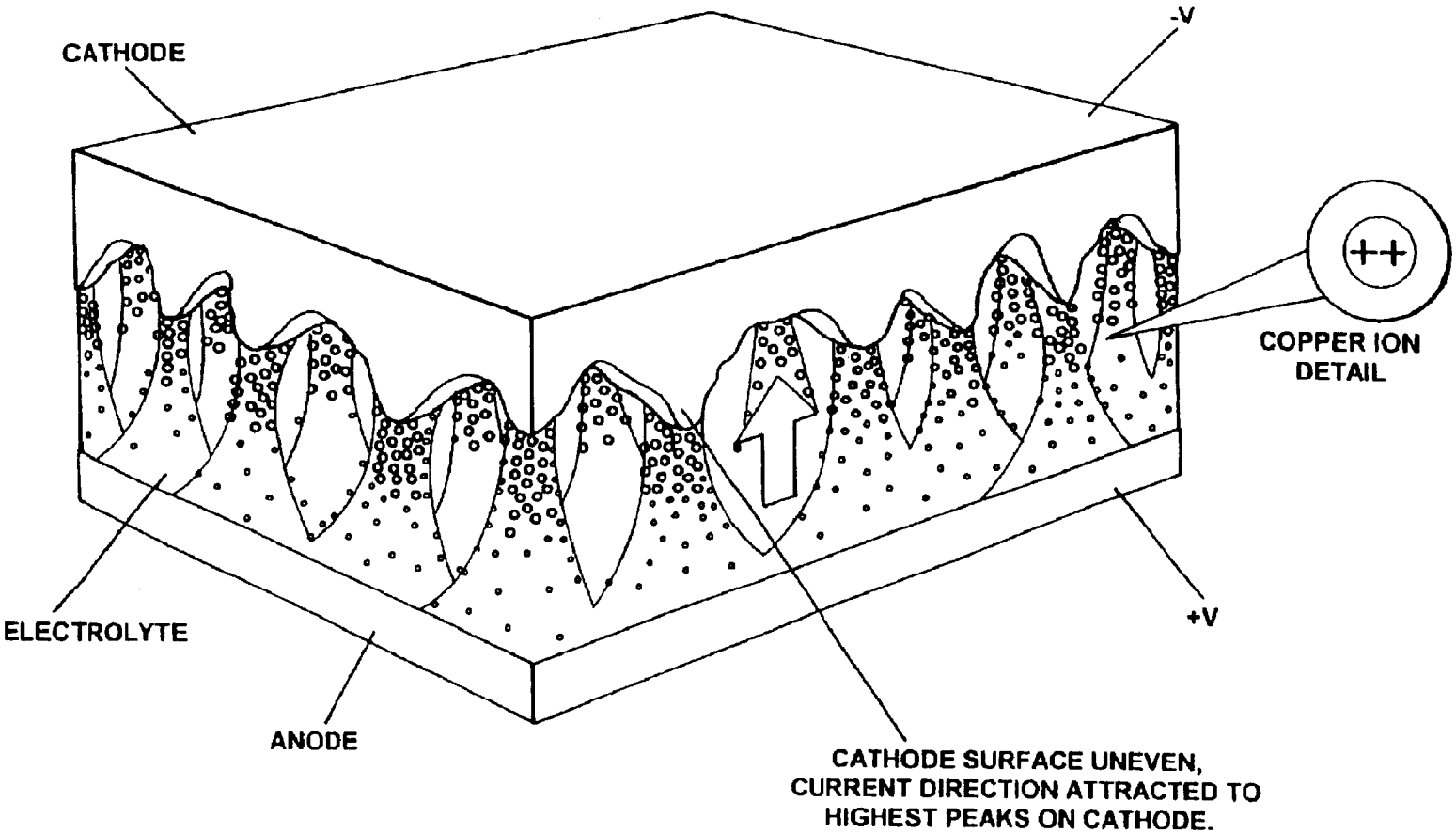

FIG. 9 is a schematic view of the actual current flow between two conducting planes with surface irregularities.

Figure 10:
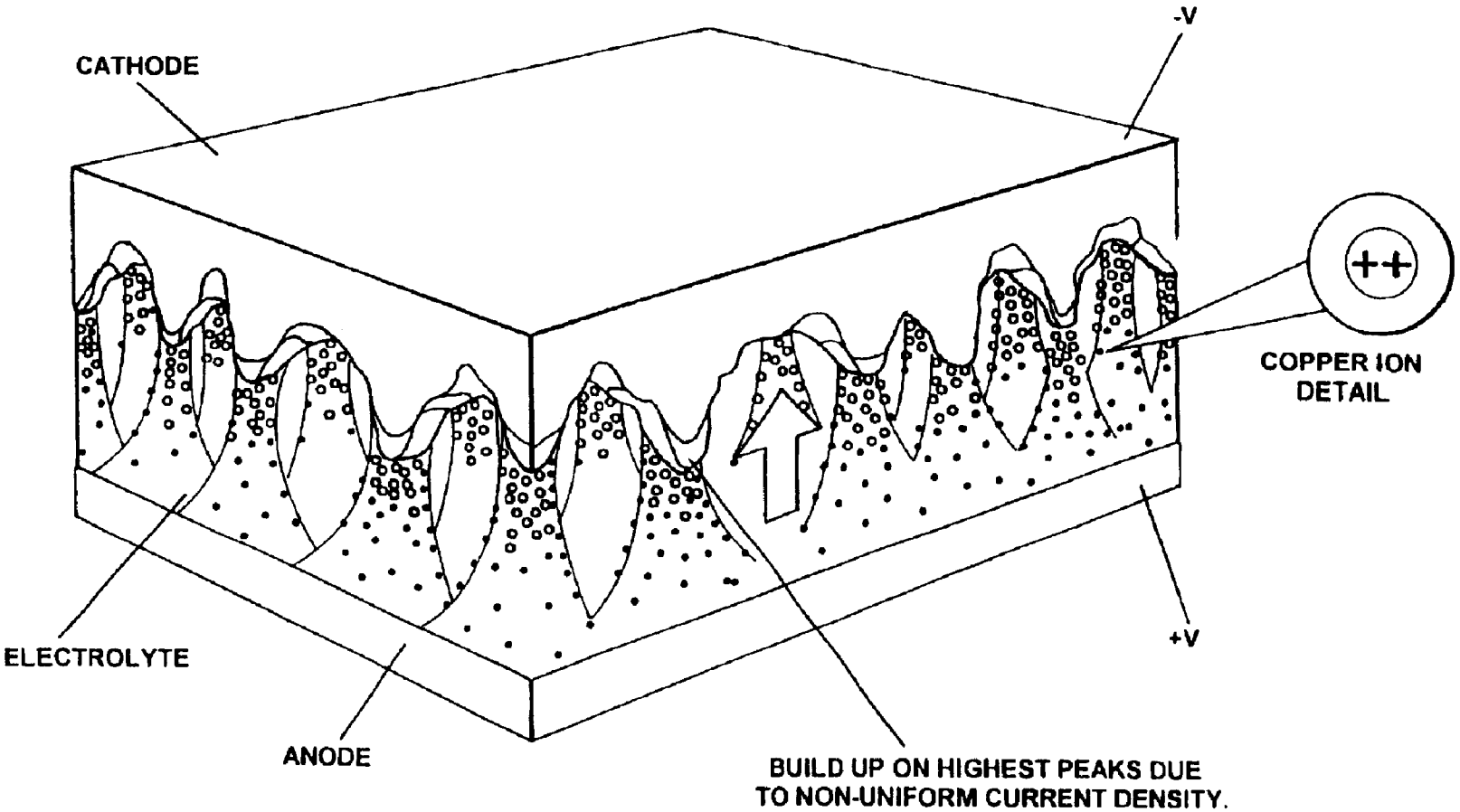

FIG. 10 is a schematic view of the peak build-up between two conducting planes.

Figure 11:
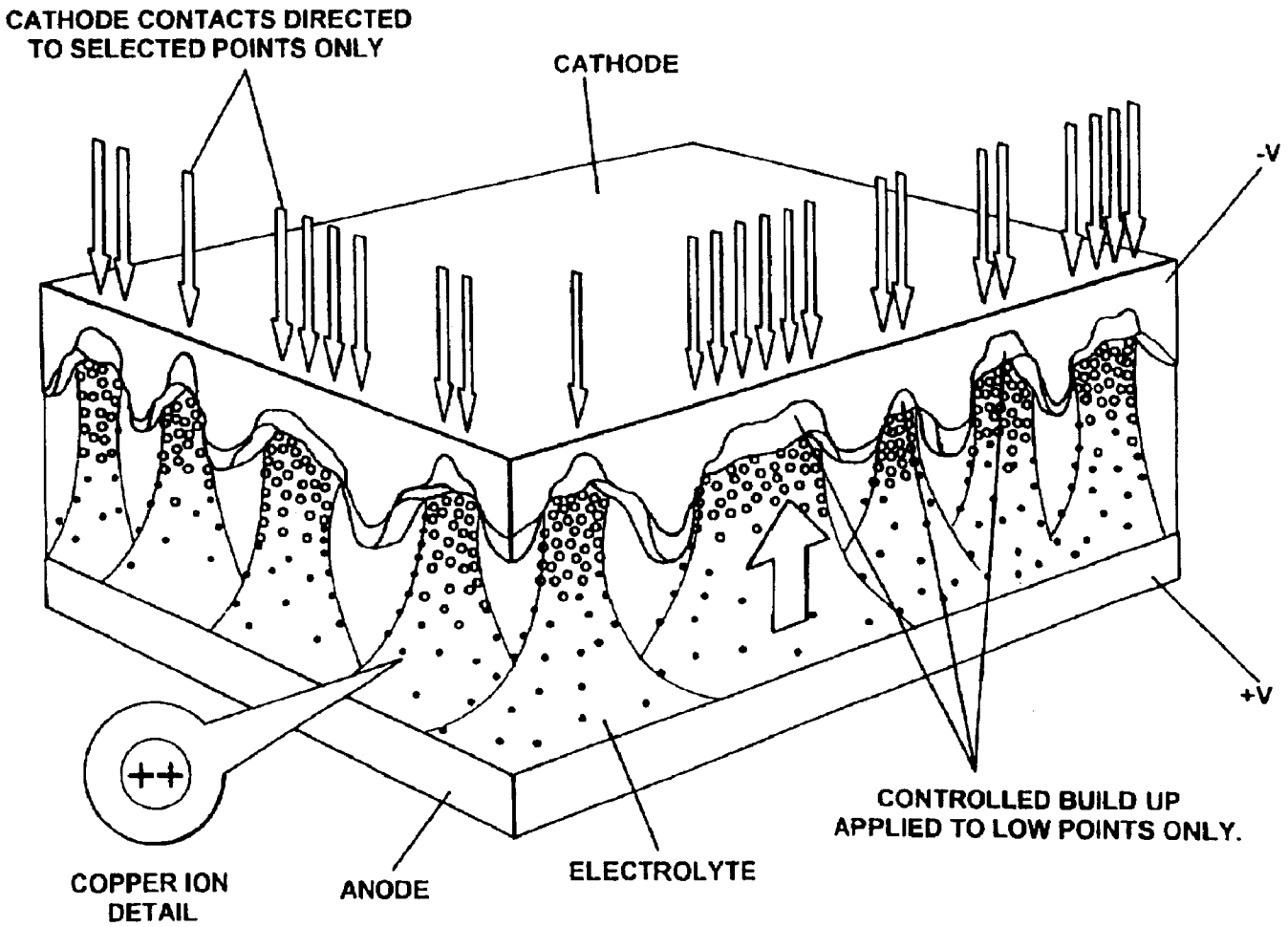

FIG. 11 is a schematic view of a current control solution between two conducting planes with surface irregularities.

Figure 12:
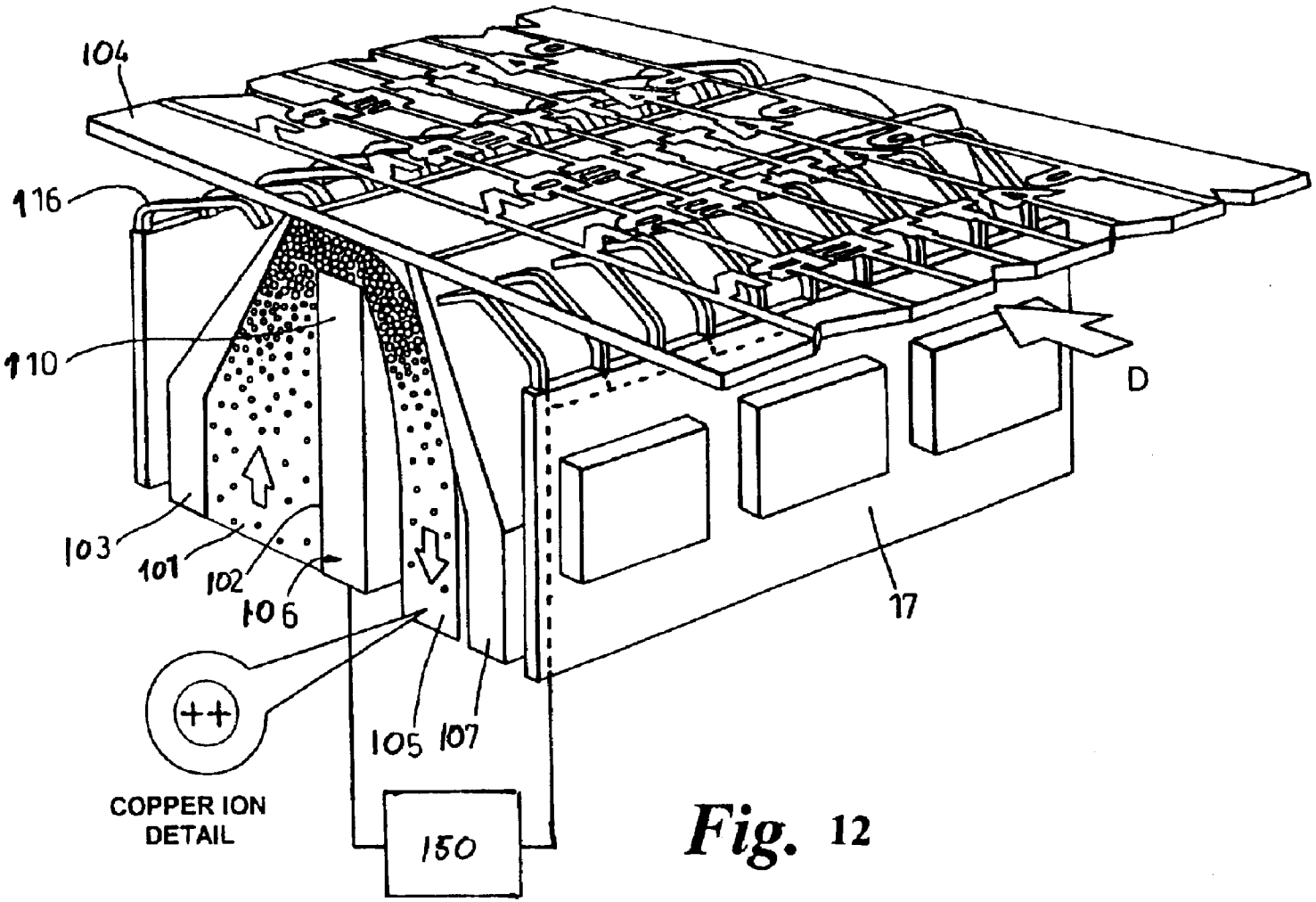

FIG. 12 is a schematic view of the present invention.

Figure 13:
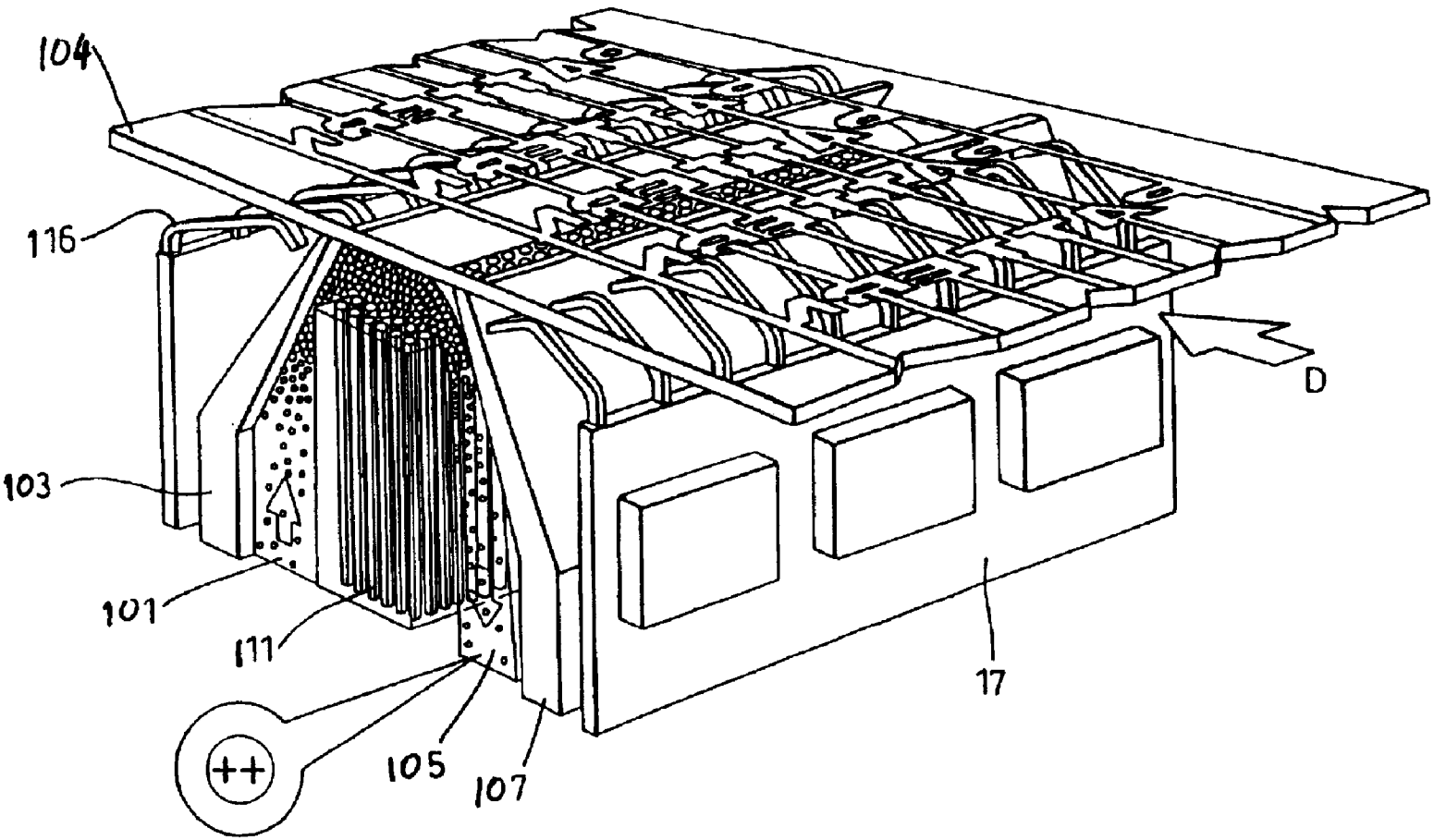

FIG. 13 is a schematic view of another form of the present invention.

Figure 14:
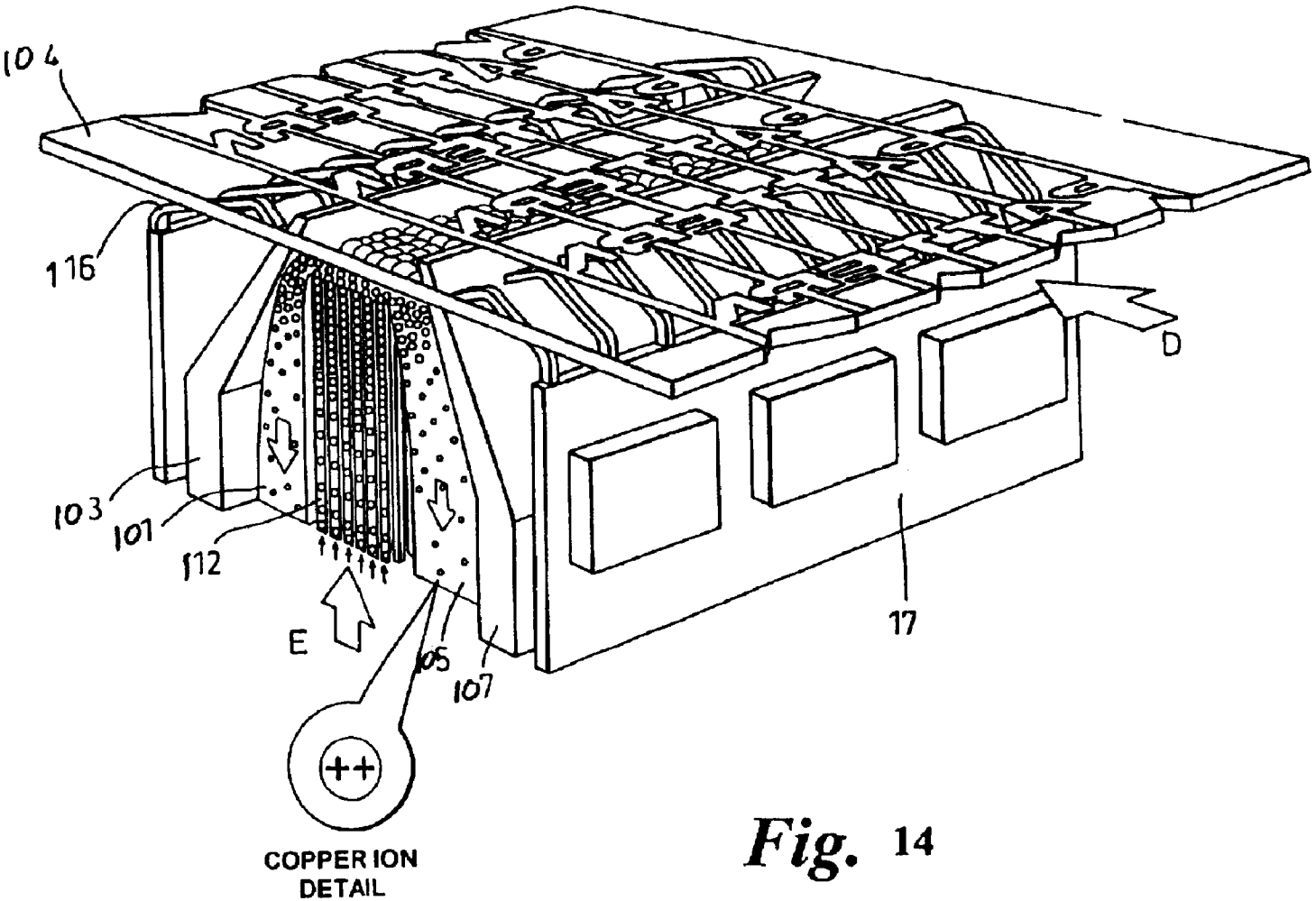

FIG. 14 is a schematic view of another form of the present invention.

Figure 15:
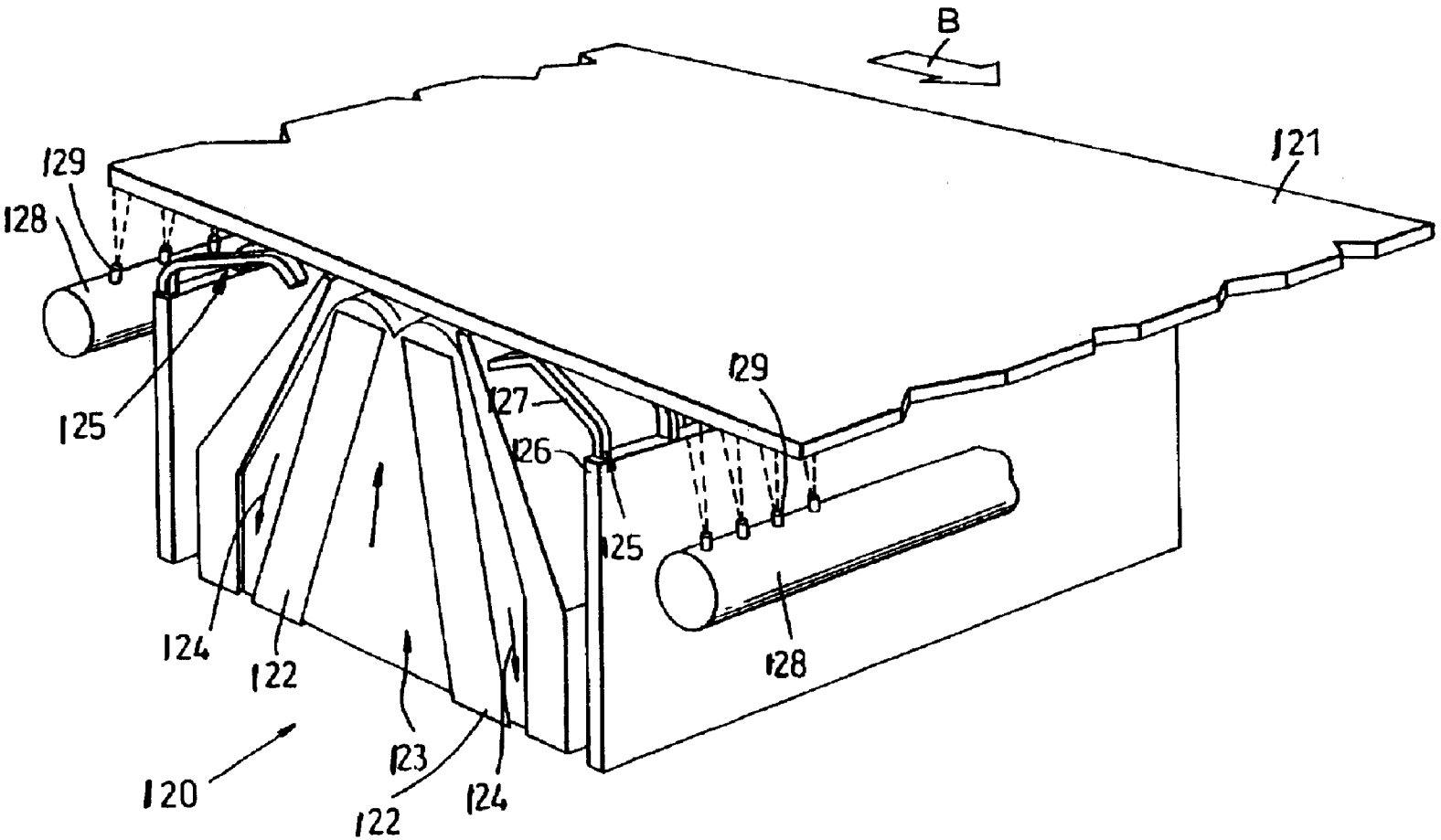

FIG. 15 is a schematic view of another form of the present invention.

Figure 16:
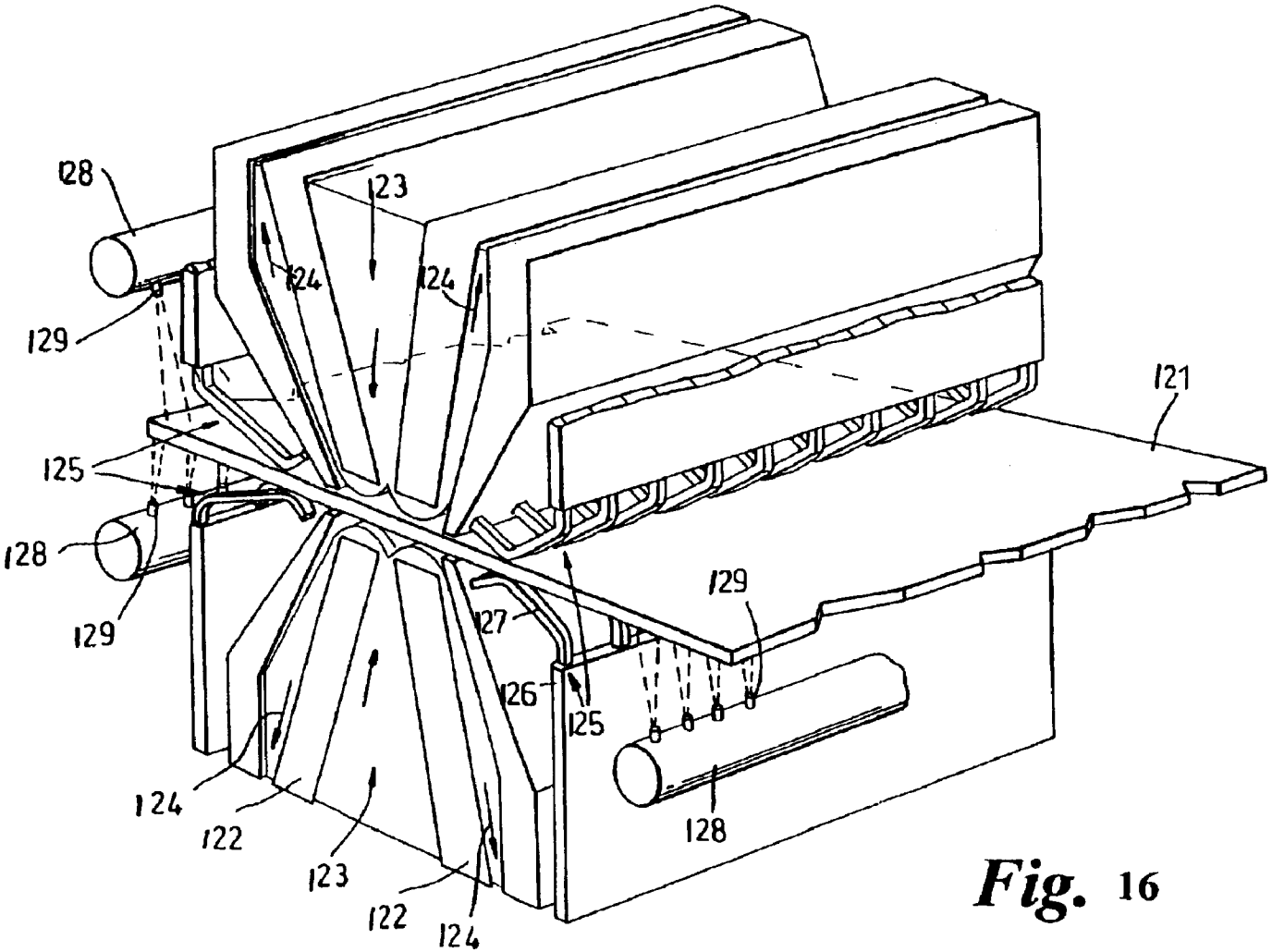

FIG. 16 is a schematic view of a variant of FIG. 13.

V. DETAILED DESCRIPTION OF INVENTION

There is shown in FIG. 1 an electroplating station S comprising a head 1 having an anode 2 of thickness $6\times10^{-3}$ meters to one side of which there is located an electrically-neutral wall 3. A passageway 4 is formed between anode 2 and wall 3 for electrolyte 5 being a solution of copper sulphate flowing at a speed of 4 liters $sec^{-1}$.

A web 6 of material of width 1 meter on which copper is to be deposited is moved at a uniform speed of 0.2 meters $min^{-1}$ over head 1, web 6 acting as a cathode. Anode 2 provides a current density of $3\times10^{4}$ Amps $meter^{-2}$ resulting in deposition of copper to a thickness of 2×10−6 meters. The speed of movement of the web 6 is maintained constant, typical speeds being up to or greater than 6 meters $min^{-1}$.

Guide 7 of wall 3 is made of flexible silicon and is shaped to enhance and maximise the production of streamwise vortices, especially those of generally circular motion, being clockwise or anti-clockwise in a plane perpendicular to the movement of the stream (see FIG. 7A) which flows upwardly along the passageway 4 and between the top surface 8 of anode 2 and web 6 at its closest point to surface 8. Anode 2 is $6\times10^{-3}$ meters wide at its top surface 8 and is 1.1 meter long to accommodate the width of web 6.

Serrations 9, which are provided on the anode 2 especially in the area of top surface 8, and a mesh 11 located in passageway 4 also contribute to the generation of these vortices. For purposes of this specification, the guides, serrations, and mesh described herein may be referred to collectively as vortices baffles. However, vortices baffles may include other conventional vortices producing structures besides guides and serrations. These resultant vortices cause substantial increase in the ion flow which overcomes the fluid and diffusion boundary layers tending to build up in the locality of the anode and web, allowing increased transfer of the ions through these boundary layers and therefore deposition of copper onto the web. In this way, the electroplating effect is substantially enhanced.

Figure 2:
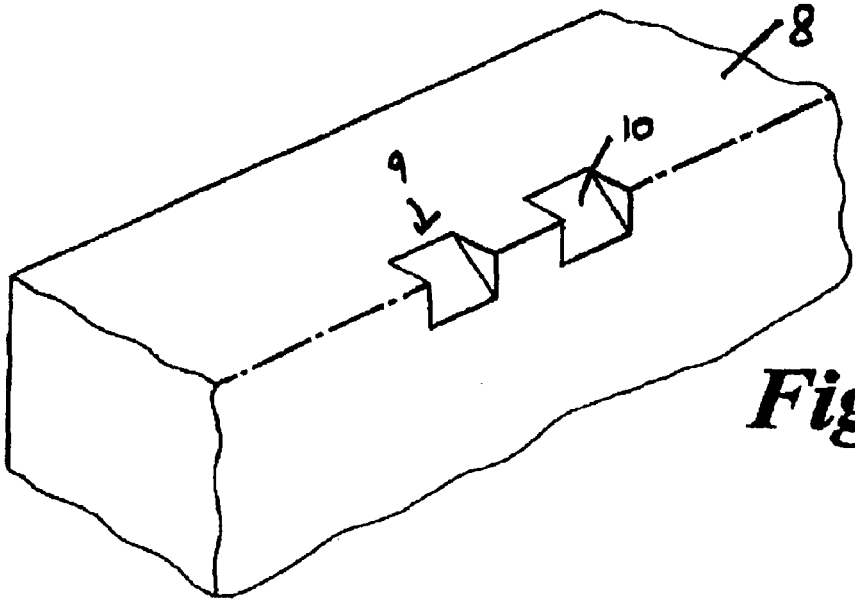
FIG. 2 is a view of serrations in the station of FIG. 1.

As shown in FIG. 2, each serration 9 comprises a face 10 inclined at approximately 45° to the top surface 8 and the vertical upstream side of anode 2 the width of each serration being $1\times10^{-3}$ meters wide, adjacent serrations being at a separation of $1\times10^{-3}$ meters. Serrations 9 extend along the entire leading edge of anode 2 which is 1.1 meter long.

FIG. 3A shows an alternative form of serrations 20 which have the same width and separation characteristics as serrations 9 but which have a different form having inclined side walls 21, 22 which meet along a common central line 23 as indicated.

Figure 3B:
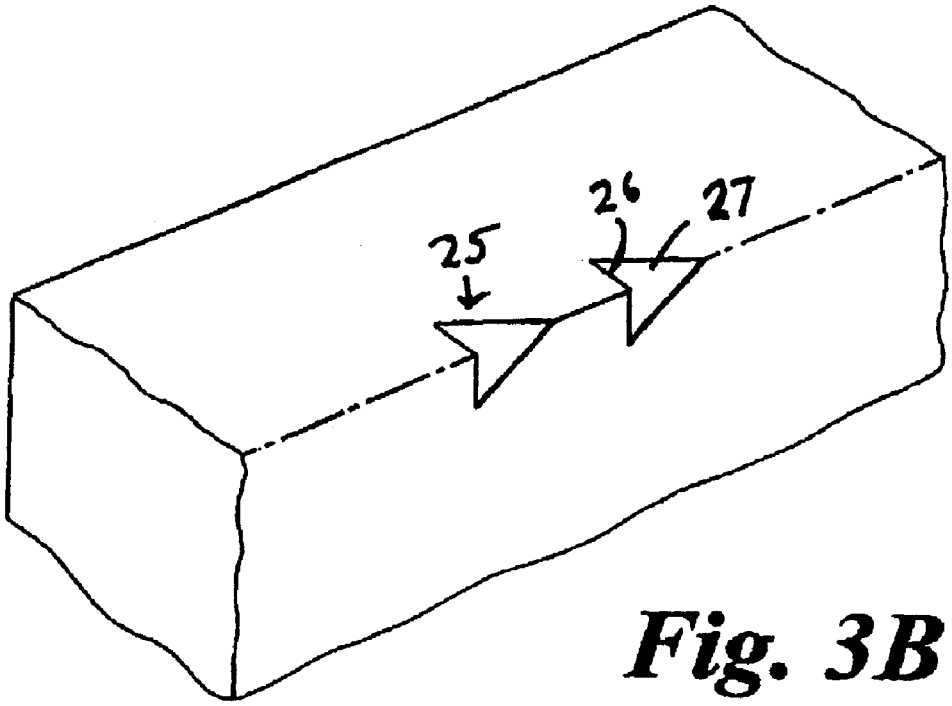
Figure 3C:
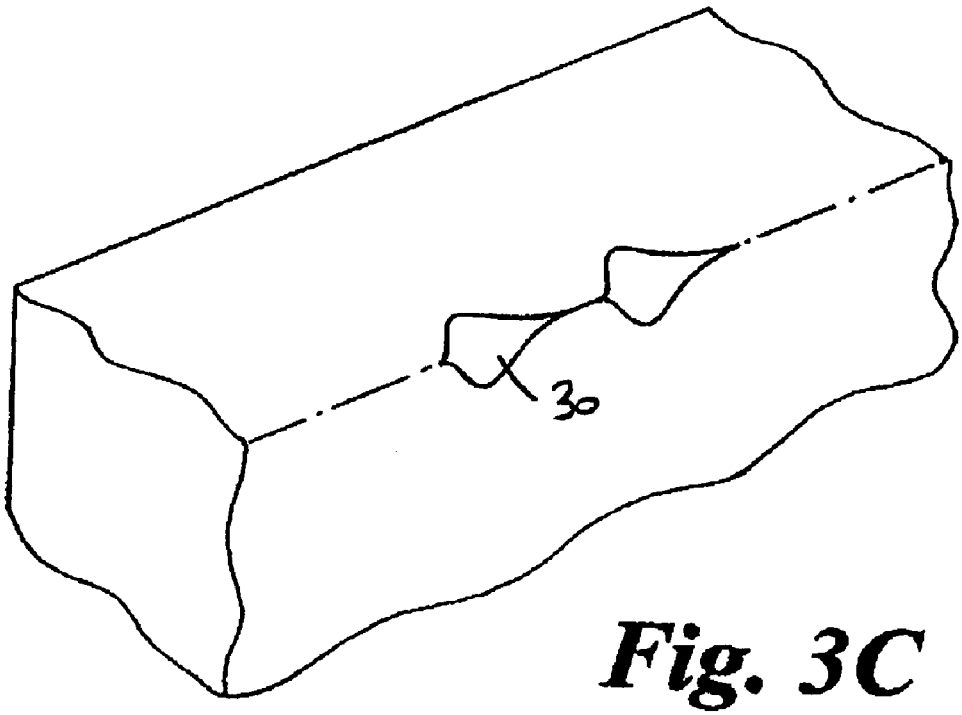

FIG. 3B shows another form wherein serrations 25 have a perpendicular face 26 and inclined face 27. Alternatively a serration can have the perpendicular face at the opposite end, or any variant in between these two situations. FIG. 3C shows a further form in which the serrations 30 are of an undulating shape. In a variant, anode 2 has a mixture of serrations, whether alternating between these types or in some other combination.

In a further variant, the serrations are of a constant width which is different to the separation between the serrations which again is constant, the widths being either greater or less than the separations. In yet a further variant, the widths of the serrations and/or their separations vary along the length of the leading edge of the anode. In this way, creation and/or enhancement of vortices may be further produced, with appropriate beneficial results in deposition rates and/or amounts.

Top surface 8 of anode 2 can be configured to effect or enhance the production of vortices, for example by having an undulating or sinusoidal form, or having regular or randomly arranged protrusions.

Electroplating station S has a mesh 11 located at a throat section 12 of passageway 4 shortly before the start of the guide 7 thereby to cause and/or enhance the production of vortices by guide 7 and/or the serrations. At its narrowest, throat 12 is about $5\times10^{-3}$ meters across. The mesh is a polyester mesh N8 type of 34.6 threads $10^{-2}$ meters with a thread diameter of $1.04\times10^{-4}$ meters giving a maximum open area of 38%.

In a variant, a mesh 13 is located further upstream in passageway 4 as an alternative and/or as an addition to mesh 11. When both meshes 11 and 13 are provided, they can be identical or they can be of different characteristics, for example mesh 13 may be of a coarser form with a greater open area and/or finer thread diameter, and mesh 11 may be of a finer form with less open area and/or thicker thread diameter. In variants, mesh 11 and/or mesh 13 may extend over only part of the passageway 4 or may be replaced by a rigid grid, a series of elongate bars with corresponding elongate apertures, or other orificed structure.

FIG. 4 shows an electroplating machine 30 comprising five in-line electroplating stations 32 to 36 each being as described with reference to station S of FIG. 1. Web 37 passes over each of the stations in turn so that an amount of copper is deposited on web 37 at each station. The current density applied at each station can be set at an appropriate level for the amount of copper to be deposited at that station as required.

For example, in one electroplating operation, it may be appropriate to supply a current density of 5000 Amps $m^{-2}$ at the first station 32 in order to deposit a layer of copper of thickness $3.33\times10^{-7}$ meters, and then to apply a current density of 30,000 Amps $m^{-2}$ at each of the subsequent stations 33 to 36 in order to deposit a layer of copper of thickness $2\times10^{-6}$ meters at each. Such a current density profile may be appropriate, for example, to ensure that current in the tracks does not burn out in a typical electroplating operation, for example with the web running at 0.2 meter $min^{-1}$.

In another electroplating operation, it may be appropriate to apply a current density profile which alternates between high and low values and/or with time, for example to give varying deposition thickness or to change the copper characteristics. In another operation, it may be appropriate to apply an increasing profile of current densities to maximise the plating rate allowed by the current carrying capacity of the conductors which connect to the negative electrode.

FIG. 5 shows a variant to the electroplating station of FIG. 1 whereby this electroplating station 40 has a rigid guide 41 which is essentially a flat uni-planar plate with a separate silicone seal 42 located behind it and curved, either naturally in its rest state or under tension by contact with web 43. Downstream of the electrolyte flow 44 is another seal 45 which again can be curved either naturally in its rest state or under tension by contact with web 43.

FIG. 6A shows a further variant to electroplating station S of FIG. 1 whereby this electroplating station 50 has an electrolyte stream 51 which flows counter to the movement of web 52. FIG. 6B is a schematic representation of an alternative electroplating head 60 having two lateral anodes 61 and 62, a central inlet passageway 63 for electrolyte 64 and a central profiled electrically neutral guide 65 shaped to split the vertically upward stream 66 of electrolyte 64 into two opposing directions 67 and 68 against the web material 69 which is moved in direction 70.

Stations 40, 50 and 60 may embody any one or more of the features of guide 7, serrations 9, 20, 25, 30 and meshes 11 and 13 as described in relation to FIG. 1.

An electroplating method of the present invention provides substantially improved interaction of the electrolyte stream and the web thereby producing improved, faster and greater deposition of the copper material on the web. Thus for example deposition rates per electroplating head of $5\times10^{-7}$ meters $sec^{-1}$ are achieved. This compares with typical deposition rates of $2.5\times10^{-8}$ meters $sec^{-1}$. achievable by conventional electroplating techniques. While reference in this specific description has been made only to deposition of copper by use of copper sulphate in solution as the electrolyte, of course the present invention is relevant for the deposition of all materials and electrolytes conventionally used in electroplating for example zinc and nickel.

FIG. 7A shows a short section of anode 2 with streams of electrolyte 5 passing thereover, the combination of serrations 9, 20, 25, 30, meshes 11, 13 (see FIG. 1) and appropriate speeds of electrolyte streams may produce vortices 60 which provide increased impingement of electrolyte, and hence ions, through boundary layers which form close to the web 6 and so provide increased contact of ions with the web 6 and thereby additional deposition of copper on the web 6.

Such vortices may be in a circular or twisting form, whether clockwise or anti-clockwise with axes of symmetry along the lines of flow, e.g. in a streamwise fashion (see FIG. 7A).

Figure 7B:
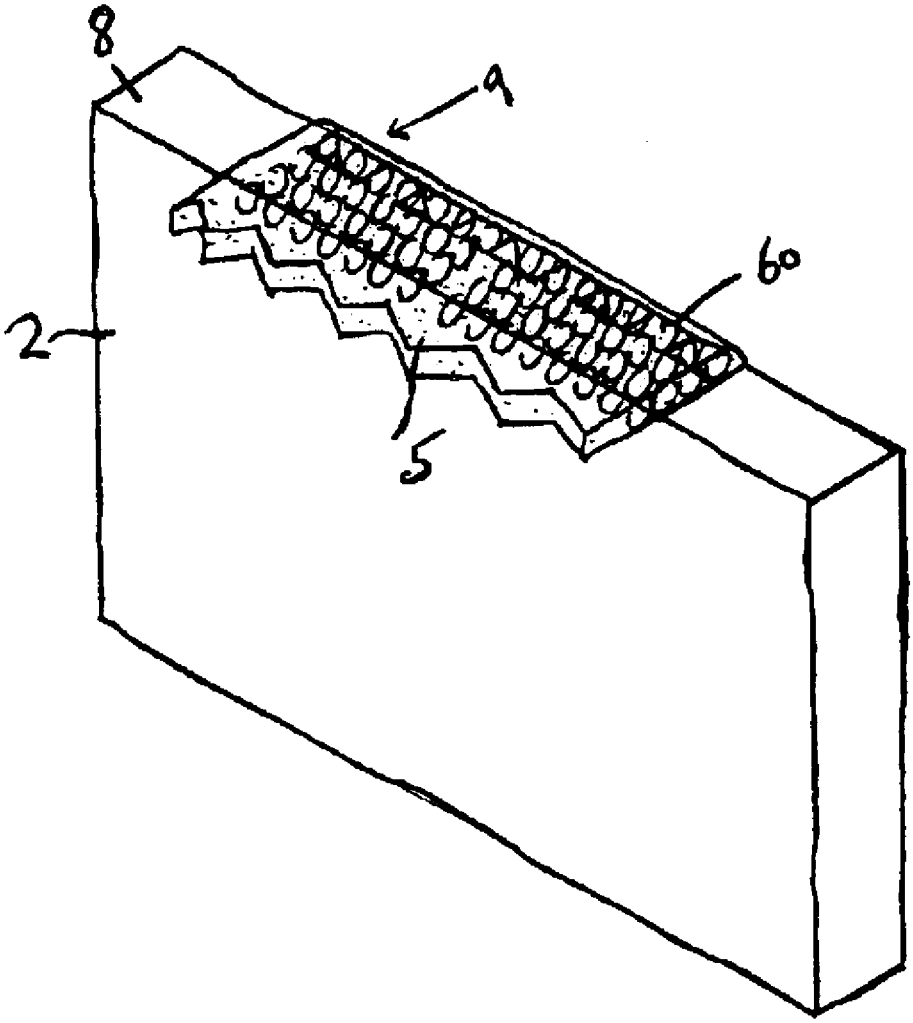

Additionally or alternatively, the vortices 60 may be in a circular or twisting form, whether being in a clockwise or anti-clockwise direction, and the axes of symmetry lie generally parallel to the leading edge of anode 2 (see FIG. 7B).

A uniform electro-plated deposit requires the same amount of current to flow into each unit area of the target. The smaller the unit area, the better the resolution of surface finish as a function of the finish before the start of deposition. The availability of suitable ions at the surface of each unit area of the target must be sufficient to support the selected deposition rate.

A method of achieving these requirements and correcting for initial irregularities is shown in FIG. 11. For the purpose of clarity, only one row and column of electrodes is shown and, of these, only those that are active to correct the given irregularity situation are shown.

In reality, the method of contacting the opposite face of the cathode with the electrode array is practical only in situations where there is no non-conducting backing or substrate used to support the cathode material.

A method for dealing with situations where there is non-conducting substrate is shown in FIG. 12. In FIG. 12 as the pattern on the transparent substrate 104 passes over the anode and electrolyte solution, it becomes the cathode. Arrow D shows the direction of substrate material flow. Negative electrodes 116 (otherwise known as cathode connectors) are typically 0.5 mm wide on 1 mm pitch and attached to printed circuit board 17.

In FIGS. 11 and 12, each unit area of the target surface is connected to the more negative potential by its own independent electrode. The current in each electrode is controlled by, typically, electronic means so that each unit area receives the same charge.

A supply of electrolyte is caused to flow between the anode and the target surface in such a manner that the hydrostatic, diffusion and other barrier layers do not prevent suitable ions being presented to the target surface at a rate, preferably, much greater than that required by the set current density.

The geometry of the apparatus, together with the electrolyte formulation, the current density and the speed with which the target surface is passed through the mechanism, are major factors which define the rate of reduction.

The embodiment of the present invention illustrated with reference to FIG. 12 comprises a single delivery channel 101 formed by, and between, inner wall 102 and baffle 103, channel 101 having dimensions of 100 mm height, 1 meter width (i.e extending across the width of the substrate 104) and 20 mm end length (i.e extending along the length of the substrate 104). Electrolyte 105 is pumped up the interior of channel 111 and is directed onto substrate 104 being a cathode maintained at −10 volts with respect to the anode, although potential differences between cathode and anode as small as 2.5 volts have been successfully employed. The upper part of the inner wall 102 of channel 101 forms the anode such that electrolyte is forced between the substrate and the upper horizontal surface of the anode 106. A second baffle 107 is provided in order to assist in collecting and removing electrolyte 105 after impingement with substrate 104, possibly for re-use.

Contact between the electrolyte 105 and substrate 104 is optimised by providing the electrolyte with a swirling motion as it passes up channel 101, thereby enhancing the creation of vortices upon impingement of the stream with the substrate to increase the reduction rate.

The apparatus described in FIG. 12 has demonstrated linear deposition using current densities being two orders of magnitude greater than those considered a maximum in conventional electro-plating technologies.

The proximity of the anode 106 to the substrate 104 and the resulting short current path of typically 1 or 2 mm together with the availability of suitable ions at the substrate surface gives a much more uniform current flow per unit area of the substrate surface compared to systems with longer current paths through the electrolyte 105. The distance from the negative electrodes to the electrolyte relative to the distance between adjacent negative electrodes defines the resolution of differential current control for arrangements shown in FIG. 11 and FIG. 12.

The embodiment of the present invention illustrated with reference to FIG. 12 comprises an anode 106 being a solid conducting bar 110 of dimension 1 meter width, 100 mm high and 20 mm end length. In the embodiment of FIG. 13, the anode is formed of a number (only twelve shown) of solid conducting rods 111 of diameter 3 mm and height 30 mm parallel to one another and arranged in a two dimensional grid structure, with a separation between their peripheries of about 1 mm, or otherwise arranged geometrically to one another so as to maximise speedy and accurate ion impingement and material deposition and maintaining the required current control features.

In the embodiment of FIG. 14, the anode is formed of a number of capillary delivery tubes 112 of external diameter 3 mm, internal diameter 1 mm and height 30 mm parallel to one another and arranged in a two dimensional grid structure across the width of the substrate being 1 meter, tubes 112 having a separation between their peripheries of 1 mm. Electrolyte 105 is pumped past the bar 110 (in FIG. 12) or the rods 111 (in FIG. 13), or up within the tubes 112 (in FIG. 14) and directed onto a target surface of substrate 104 forming a cathode. Bar 110, rods 111 or tubes 112 as appropriate form an anode maintained at +10 volts with respect to the cathode. A baffle 107 is provided at the exit of the channel 101 in order to assist in collecting and removing electrolyte 105 after impingement with substrate 104, possibly for re-use.

More specifically, FIG. 13 shows an electro-plating apparatus in which the anode consists of multiplicity of separate rods 111 encased in plastic, each having the current flowing in it monitored and controlled in a similar manner to that previously described for the negative electrodes. Because the upper surface of the anodes is relatively close to the surface on which the ion reduction is to be made, and therefore the path of the current from each anode segment to the cathode is shorter, or may be made shorter, than the distance between the axes or horizontal spacing of the anode segments, the resolution of areas of differential current control is much improved with respect to that available from the arrangement of FIGS. 10, 11 and 12.

Because current monitoring and regulation may be performed in the anode element circuits in the method shown in FIG. 13, the monitoring and control of current in the negative electrodes is no longer essential. Situations may arise, where to achieve the optimum ion reduction resolution, both anode and negative electrode current monitoring and control may be employed. However, the major function of the negative electrodes in the method shown in FIG. 13 is to provide electrical connection between the negative potential and the features onto which ion reduction is to be made. The geometry of the negative electrodes with respect to the anodes and electrolyte defines the resolution of the feature size onto which ion reduction may be made. The multiple anode system and the associated factors controlling ion reduction and features resolution are equally applicable to applications where there is no substrate or a conducting substrate and the negative electrodes may be contacted to the opposite side of the substrate or cathode to that onto which ion reduction is required.

FIG. 14 shows a further development of the composite anode system of FIG. 13. In this case, the anode rods are in the form of hollow tubes and the electrolyte is delivered through the tubes en route to the deposition surface in the direction of arrow E. The hollow anode principle may be more simply realised by using two bars with the electrolyte caused to flow between them (see FIGS. 15 and 16). The hydrostatic barrier layer of the electrolyte 105 at the surface of the substrate 104 is dependent upon the velocity of the electrolyte in a direction parallel to the substrate plane. Therefore correct design of the electrolyte flow in this system gives further reduction of the various barrier layers compared to that achieved by the "swirling only" method. The reduction is caused by the initial flow of the electrolyte being normal to the substrate until the electrolyte strikes the substrate. The design of this system must inhibit the creation of any areas of stagnation of electrolyte at the substrate surface. Avoidance of stagnation may be achieved by the introduction of swirling.

To achieve the maximum resolution of differential current control with arrangements as shown in FIG. 12, the distance from the negative electrodes to the electrolyte relative to the distance between adjacent negative electrodes is as small as possible. Therefore, the arrangement shown in FIG. 12 requires both the distance from the negative electrodes' contact point to the electrolyte and the width of the electrolyte between the two sets of electrodes to be as small as possible.

The arrangements shown in FIGS. 13 and 14 do not have this restriction because the length of the controlled current paths are defined by the distance from substrate to anode and therefore allow for the use of anode structures which are larger in the dimension between the two sets of negative electrodes. This allows for faster transit times of the substrate or for greater ion reduction rates for the same transit time. The limitation of anode size, and therefore distance between the two sets of negative electrodes, is the minimum size of the features onto which material is to be deposited.

Where it is required to deposit material on features which do not allow for the use of negative electrode structures as shown in FIGS. 12, 13 and 14, the use of negative electrodes of the same shape as the anodes of FIG. 10 and intermingled with the anode array or the use of concentric anode—cathode rods/tubes may be employed. In both cases, the contact point of the negative electrodes to the substrate must be protected from the electrolyte either by de-ionised water stream, as used to protect the negative electrodes of FIGS. 11, 13 and 14 from electrolyte contamination, or by other suitable means.

The rods and tubes of FIGS. 13 and 14 are shown parallel. However in variants they are not parallel, for example they may be straight or curved with their upper ends closer together than the rest of them, and/or one or more of them may be in a spiral or helical form to impart a circulatory, swirling or vortex motion to the electrolyte.

The current in the (positive and/or negative) electrode associated with each region may be controlled by control circuit 150 shown in FIG. 12. Control circuit 150 will measure the current flowing in each electrode, compare this with a desired value and then increase or decrease the current to the desired value. Control circuit 150 may quantify the current flowing in each electrode by any conventional manner such as by measuring the voltage developed across a suitable resistor placed in the electrode circuit. Control circuit 150 may also regulate the current flowing in each electrode circuit by any conventional manner including analogue or digital techniques.

In situations where the pattern, on which material is to be deposited, is repetitive the current profile with time or distance of each electrode may be pre-programmed for optimum results. Each cycle of current profile may be initiated by a marker concurrent with or preceding each repetitive pattern.

FIG. 16 shows a simple hollow anode system with part of the electrolyte flow normal to the target surface.

FIG. 15 shows an electro-plating apparatus 120 for plating a rigid or flexible substrate 121. Apparatus 120 comprises a hollow anode 122 through the centre of which electrolyte 123 is directed onto a portion of substrate 121 moving in direction B and then removed along side channels 124. Cathodes 125 are in the form of comb main portions 126 with teeth 127 to ensure that unconnected regions of substrate 121 are electrically connected to cathodes 125 before and after impingement of electrolyte 123 to ensure that there is adequate deposition of material onto all required parts of substrate 121.

Two cleaners 128 with nozzles 129 are provided to direct de-ionised water onto the substrate 10 before and after contact with cathodes 125.

FIG. 16 shows a variant of the apparatus of FIG. 15 but wherein both sides of substrate 121 are plated.

The anodes described above are of the non-sacrificial type and are made of a material which resists erosion to maintain the geometric integrity.

The electrolyte composition may be maintained by the addition of appropriate salts or by the use of secondary sacrificial anodes.

Whichever system is used, the power requirement is reduced compared to conventional methods due the close geometric relationship of the anodes(s) and the cathode.

What is claimed is:

1. An electro-plating apparatus comprising:

a. an inlet channel for directing an electrolyte stream to a target;

b. a control circuit controlling the amount of reduction and/or rate thereof, of ions in selected regions of said target; and c. a vortices baffle positioned in the vicinity of said regions, thereby enhancing the creation of vortices upon impingement of the stream with the said regions in order to increase the ion reduction rate.

2. An apparatus according to claim 1 wherein said vortices baffle comprises a shaped body such that vortices are created or enhanced in said electrolyte.

3. An apparatus according to claim 2 wherein said shaped body comprises a flat plate positioned in the apparatus such as to create or enhance vortices in said electrolyte.

4. An apparatus according to claim 1 wherein said vortices baffle comprises an arcuate body to create or enhance vortices in said electrolyte and form a seal with a moving web on which material is to be deposited.

5. An apparatus according to claim 1 wherein said vortices baffle comprises serrations on an anode.

6. An apparatus according to claim 5 wherein said serrations comprise at least one of the group consisting of:

a. a plurality of recesses in a top face of said anode;

b. a plurality of recesses in a side face of said anode; and c. a plurality of recesses, each of which extends in a top face and a side face of an anode.

7. An apparatus according to claim 5 wherein said serrations have at least one of the group consisting of:

a. a rectangular or square profile in a face of the anode;

b. a rectangular or square profile in each the upper face and side face of an anode;

c. a triangular profile in a face of said anode;

d. a triangular profile in each of the upper faces and side faces of an anode; and e. a plurality of differing profiles or cross-sections.

8. An apparatus according to claim 1 wherein said vortices baffle comprises a mesh extending across part or all of a passageway for electrolyte upstream of said regions.

9. An apparatus according to claim 8 wherein said mesh extends across part or all of a passageway for electrolyte upstream of and adjacent to said regions.

10. An apparatus according to claim 1 wherein said control circuit comprises a means to regulate the size and/or duration of current applied to each of a plurality of separate regions of the target.

11. An apparatus according to claim 1 wherein said control circuit is operable to provide a material deposition layer on the target wherein different regions have predetermined reduction thicknesses.

12. An apparatus according to claim 1 wherein said control circuit is operable to provide a target with a uniform deposition thickness in selected regions.

13. An apparatus according to claim 1 further comprising an anode wherein said anode is at least one from the group consisting of:

a. a single element anode;

b. a plurality of generally parallel solid rods; and c. a plurality of generally parallel tubes through which electrolyte passes.

14. An electro-plating apparatus comprising:

a. means to direct an electrolyte stream to a target;

b. means to control the amount of reduction, and/or rate thereof, of ions in selected regions of said target, said control means comprising:

i. means to measure the current flowing to said regions of said target, and ii. means to control the current applied to said regions, and c. mesh means for location in the electrolyte stream to produce and/or enhance the creation of vortices upon impingement of the stream with the said regions in order to increase the ion reduction rate.

15. Apparatus according to claim 14 wherein the mesh means extends across part or all of a passageway for the flow of electrolyte.

16. Apparatus according to claim 14 wherein the mesh means is located upstream and adjacent to said regions.

17. Apparatus according to claim wherein the mesh means comprises a rigid gild.

18. Apparatus according to claim 14 wherein the mesh means comprises an orificed structure.

19. A method of electroplating comprising the steps of:

a. providing an electrolyte channel which includes: a first wall, a second wall, a first electrode positioned between said walls, and a substrate contact area between said walls and above said first electrode;

b. positioning a second electrode adjacent to said substrate contact area;

c. positioning a vortices baffle within said electrolyte channel;

d. flowing a stream of electrolyte through said electrolyte channel; and e. moving a substrate larger than said substrate contact area across said second electrode and said substrate contact area, such that only a portion of said substrate is in contract with said electrolyte at any given time.

20. The method according to claim 19 wherein a swirling motion is caused in said electrolyte stream as it passes said substrate contact area.

21. The method according to claim 19 wherein said first electrode is an anode and said second electrode is a cathode.

22. The method according to claim 21 wherein a vortices baffle is positioned on or near said anode.

23. The method according to claim 22 wherein said vortices baffle is a plurality of serrations upon a top portion of said anode.

24. A method of electroplating comprising the steps of:

a. directing a stream of electrolyte to a target region;

b. controlling the amount of reduction, and/or rate thereot, of ions in selected regions of the target;

c. measuring the current flowing to said target region;

d. controlling the current applied to said target region; and e. swirling said electrolyte to enhance the creation of vortices upon impingement of the stream with said regions thereby increasing the ion reduction rate.

* * * * *